United States Patent [19]

Kelsey

[11] Patent Number: 4,901,741

[45] Date of Patent: Feb. 20, 1990

[54] HAIR WAVING DEVICE

[75] Inventor: Martha Kelsey, Fairfield, Iowa

[73] Assignee: Uptown Products, Inc., Fairfield, Iowa

[21] Appl. No.: 208,681

[22] Filed: Jun. 20, 1988

[51] Int. Cl.[4] ..... A45D 6/14; A45D 6/16

[52] U.S. Cl. ..... 132/251; 132/245; 132/253

[58] Field of Search ..... 132/212, 223, 226, 245, 132/246, 247, 248, 249, 251, 252, 253, 254, 255, 259, 260

[56] References Cited

U.S. PATENT DOCUMENTS

| | | | |
|---|---|---|---|
| 23,842 | 5/1859 | Ivins | 132/251 |
| 189,804 | 4/1877 | Smith | 132/251 |
| 1,055,603 | 3/1913 | Brewington | 132/259 |
| 1,349,609 | 8/1920 | Ellert | 132/251 |
| 3,073,318 | 1/1963 | Catania | 132/251 |
| 3,090,389 | 5/1963 | Eckman | 132/251 |
| 3,335,734 | 8/1967 | Kackloudis | 132/251 |
| 3,415,255 | 12/1968 | Mitsumoto | 132/251 |

*Primary Examiner*—Gene Mancene
*Assistant Examiner*—Michael Lynch
*Attorney, Agent, or Firm*—James C. Nemmers

[57] ABSTRACT

A non-heated hair waving device for producing perm-like curls and waves in the hair. The device has a U-shaped curler with outwardly flared ends around which the hair is woven in a figure eight pattern. A unique end clip is slid onto the ends of the U-shaped curler and folded over the ends of the hair and locked to hold the hair firmly in place.

9 Claims, 1 Drawing Sheet

HAIR WAVING DEVICE

BACKGROUND OF THE INVENTION

Individuals have been curling and waving their hair for many, many years using a variety of devices. There are of course devices for curling hair that are heated, usually by electricity, to give a set to the curl or wave. However, many hair curling devices have been used that require neither heat nor electricity to produce the desired results. Usually, these hair curling devices take the form of a cylindrical shaped object around which the hair is wound and then held in place by a hollow cylinder, hair pins, or special clips. These devices come in a variety of sizes depending upon the curl or wave that the user wishes to produce, but the known devices are usually bulky and uncomfortable to sleep on even if they are made out of a soft material such as a foam plastic. Also, most prior art devices will produce only one type of curl, and in order to produce a different type or size of curl or more gentle wave, it is necessary to use different size devices. The user thus must keep a supply of a variety of devices which are quite bulky and which take up a considerable amount of room to store. Moreover, many of the prior art devices are somewhat difficult to use, and although they produce hair that is curly, it is difficult to simulate the look of a "permanent" on a temporary basis unless chemicals are applied to the hair.

It is therefore an object of the invention to provide a new and unique hair waving device that will provide the look of a perm on a temporary basis without the use of chemicals. It is a further object of the invention to provide a hair waving device that is simple to use and which also can be used to provide a variety of styles of waves.

It is a further object of the invention to provide a hair waving device that is not uncomfortable to sleep on, is not bulky and is relatively inexpensive to manufacture.

SUMMARY OF THE INVENTION

The hair waving device of the invention consists of a U-shaped curler, the ends of which are flared outwardly. The curler may be provided in different lengths for use on different lengths of hair. The hair is wound around the curler, preferably in a figure eight pattern, and then a unique end clip is fastened to the end of the curler to hold the hair in place. The end clip is of a soft plastic that is hinged in the middle, and contains openings so that it can be slid onto the free ends of the curler after which it is folded over and snapped together using integral snaps to firmly hold the ends of the hair in place. The end clip is also provided with built in "grippers" and preferably is provided with air holes so that the hair inside the clip will dry quickly if the hair has been set while damp.

DESCRIPTION OF THE PREFERRED EMBODIMENT OF THE INVENTION

Figure 1:
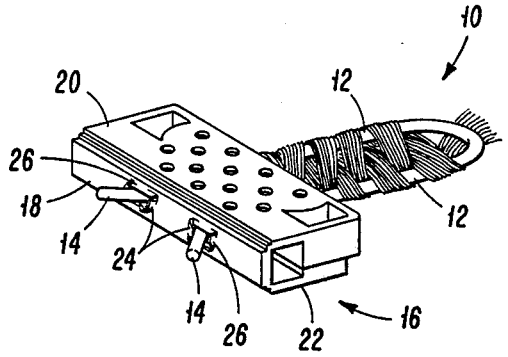
FIG. 1 is a perspective view of the curler and end clip of the invention showing them with the hair wound around the curler and the end clip locked in place over the ends of the hair.

The device of the invention for curling and waving hair includes a U-shaped curler 10 that has legs 12 the outer ends 14 of which are flared outwardly as best seen in FIG. 1. The other component of the hair waving device is an end clip indicated generally by the reference numeral 16 and more fully described hereinafter.

As illustrated in FIG. 1, the user winds the hair firmly in and around the legs 12 of the curler in a figure eight pattern, with the free ends of the hair terminating usually near the ends 14 of the curler 10. The curlers 10 are preferably made of different lengths for ease of use, the shorter curlers 10 being used for the shorter lengths of hair, such as bangs. The curlers 10 that are longer could also be used for shorter lengths of hair, but it generally is easier to use the device of the invention when the finished wound length hair matches the length of the curler.

The legs 12 of the curler can be of any suitable diameter, but the preferred diameter is 3/16". The relatively large diameter of the legs 12 serves to make softer waves in the hair, and also gives the user the option to wind the hair around only one of the legs 12 rather than winding the hair in and around both legs 12 in a figure eight pattern. Also, in order to provide waves with more curl at the ends of the hair, the user can weave the hair around both legs 12 in a figure eight pattern and then wind the last half-inch or so of hair around only one leg 12 thus assuring that the ends of the hair will be curled instead of straight. The flared ends 14 of the curler 10 make it easier to weave the hair around the legs 12 of the curler 10 and also assist, to some degree, to help retain the end clip 16 in place as more fully described hereinafter.

After the hair is wound around a curler in the desired manner by the user, the end clip 16 is used to hold the hair firmly in place on the curler. The end clips 16 are designed so as to be quickly and easily used regardless of the thickness of the hair wound on the curler 10. They also will retain the hair in place even though the hair may be wound and cover only a portion of the legs 12 of the curler 10.

Figure 2:
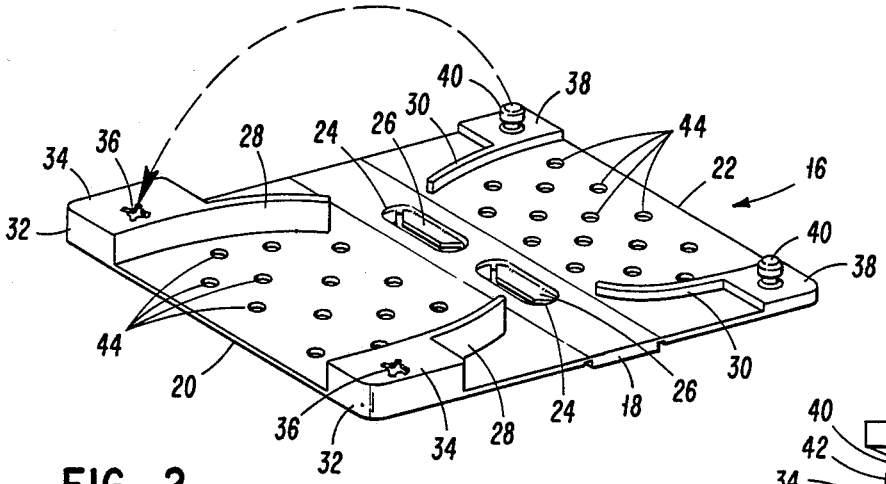
FIG. 2 is a perspective view of the end clip showing the end clip in its unfolded position and illustrating the inside construction of the end clip.

Each end clip 16 has a center portion 18 along each side of which there is hingedly attached a first side portion 20 and a second side portion 22. The end clip is preferably molded from a soft flexible plastic material, and preferably the clip 16 is molded in one piece. The hinge connections between the center portion 18 and the first and second side portions 20 and 22 are therefore formed by a difference in the thickness along the edges of the center portion 18 that will provide for the folding of the side portions 20 and 22. This is best seen in FIG. 2 of the drawings.

The center portion 18 is provided with two oblong openings 24 which are spaced apart so that the distance between the outer most edges of the openings 24 is approximately the same as the distance across the legs 12 of the curler 10. Also, the distance from between the flared ends 14 is greater than the distance outside the outside edges of openings 24. Thus, in order for the end clip 16 to be slipped over the ends 14 of the curler 10, the legs 12 would have to be squeezed together slightly. Since the curler 10 is preferably made also of a flexible and somewhat resilient plastic material, when the legs 12 of the curler 10 are squeezed together, they will tend to return to their original position in which the legs 12 are generally parallel.

To further aid in retaining the end clip 16 in place on the curler 10, each of the openings 24 is formed so that there are projections 26 extending inwardly and partially covering each opening 24. The thickness of the projections 26 is somewhat less than the thickness of the center portion 18 so that the projections 26 will bend outwardly as the end clip 16 is slid onto the legs 12 of the curler 10. However, because of the inherent resilience of the material from which the end clip 16 is formed, the projections 26 when displaced by the legs 12 will tend to return to their original position partially blocking the openings 24 and thus providing a friction grip on the legs 12 thereby keeping the end clip from slipping off the curler 10. Also, as previously mentioned, the flared ends 14 of curler 10 aid in retaining the end clip 16 in place since it requires additional force to move the legs 14 toward each other so that the flared ends can pass through the openings 24.

Figure 3:
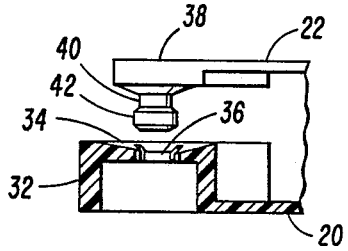
FIG. 3 is a side elevational view, partly in section, of that portion of the end clip that provides for holding the sides of the end clip together locking them in place.
Figure 4:
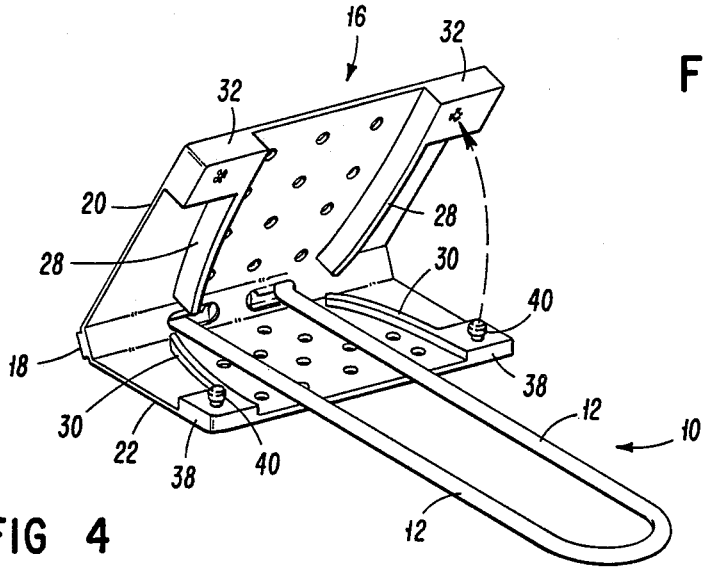
FIG. 4 is a perspective view showing the curler and end clip in place with the end clip partially closed.

Each of the side portions 20 and 22 are also provided with inwardly extending curved walls, the walls on side portion 20 being designated by the reference numeral 28 while the walls on side portion 22 being designated by the reference numeral 30. These walls are curved slightly inwardly toward the center portion 18, and as best seen in FIG. 2, walls 28 are somewhat higher than walls 30. However, the combined height of the walls 28 and 30 are approximately equal to the width of the center portion 18 so that when the side portions 22 and 24 are folded inwardly and locked into the position shown in FIG. 1, the walls 28 and 30 will tend to engage each other and form an enclosure to keep stray strands of hair inside of the end clip 16. The walls 28 and 30 are curved inwardly toward the center portion 18 to create extra force that helps hold the last portion of the hair in place, even though the hair may be wound around just one leg 12 of the curler 10. To retain the end clip in its closed position as shown in FIG. 1, the first side portion 20 is provided with an upstanding base 32 at each of its outer corners. Each base 32 has a top wall 34 that is concave and which contains an opening 36. The second side portion 22 also has a corresponding base 38 at each of its outer corners, and extending upwardly from each base 38 is a locking lug 40 that has an enlarged head shaped somewhat like a mushroom. Thus, when the side portions 20 and 22 of the end clip 16 are folded toward each other, the locking lugs 40 will engage the top wall 34 of the base 32 on the side portion 20, and because of the concave shape of the top wall 34, the locking lugs 40 will be guided into the openings 36. Since the diameter of the head 42 on the locking lug 40 is slightly larger than the corresponding opening 36, once the head 42 passes through the opening 36, it will lock in place. This locking may be facilitated by forming cross slits in the openings 36 as best seen in FIG. 2. Engagement and locking is also facilitated by tapering the heads 42 as best seen in FIG. 3.

Once the end clip is in place over the legs 12 of the curler 10 and is closed and locked in place as shown in FIG. 1, the ends of the hair held by the end clip 16 are enclosed by the side portions 20 and 22 and the walls 28 and 30. Therefore, to facilitate quick drying of the hair inside of the end clip 16, a plurality of openings 44 are preferably formed in each of the side portions 20 and 22.

The use and advantages of the device of the invention are evident from the foregoing description. However, its use is summarized as follows. The user winds the hair in whatever desired manner around the legs 12 of the curler 10, preferably weaving the hair in a figure eight pattern over both legs 12 with the last half-inch or so of the hair being wound around only one of the legs 12. The user would then slip an opened end clip 16 over the ends of the legs 12 of the curler by passing the legs 12 through the openings 24 and moving the end clip along the legs until the ends of the hair are near the center portion 18. With one hand, the user can then fold the side portions 20 and 22 toward each other and easily press the locking lug 40 into the openings 36 to snap-lock the side portions 20 and 22 in a closed position as shown in FIG. 1. In this position, the ends of the hair will be held firmly in place by the end clip 16, and the end clip 16 will be retained in place by the gripping action of the projections 26 on the legs 12. When thus snapped closed over the curler 10, the end clip 16 is not much thicker than the curler 10 itself, and thus they do not create any discomfort to the user even if slept on. Also, because the end clips 16 are made of a flexible soft plastic, the end clips 16 bend easily around the curlers 10, and even if a lot of hair has been wound on the curler 10, there is sufficient flexibility in the side portions 20 and 22 to accommodate the thickness while still applying pressure on the hair to maintain the hair in place and also maintain the end clip 16 in position on the curler 10. It has been my experience that the end clip 16 will stay in place on a curler 10 until the user unsnaps the locking lugs 40 by disengaging them from the openings 36. This can be easily done by placing a finger or thumb between the side portions 20 and 22 and moving them apart. Also, an end clip 16 can be removed from the curler 10 merely by applying sufficient pressure to slide it off the ends 14 of the legs 12, squeezing the legs 12 together as necessary to allow the end clip to be disengaged from the curler 10.

Having thus described the invention in connection with the preferred embodiment of it, it will be evident to those skilled in the art that various revisions and modifications can be made to the preferred embodiment disclosed without departing from the spirit and scope of the invention. It is my intention however that all such revisions and modifications that are obvious to those skilled in the art will be included within the scope of the following claims.

What is claimed is:

1. A hair waving device comprising a U-shaped curler having generally parallel legs joined at their inner ends and open at their free ends, an end clip removably combined with the free ends of the curler to retain in place hair wound on the curler, the end clip having a first thin wall and a second thin wall hingedly secured to the first wall to form a hinged connection so that the walls are moveable toward and away from each other, a pair of openings between the first and second walls along the hinged connection between them, the openings being spaced apart a distance to receive the legs of the curler and to allow the end clip to be slid onto the legs of the curler, and locking means for securing the first and second walls together when moved toward each other to cover the ends of the hair wound on the curler.

2. The hair waving device of claim 1 in which the curler is of somewhat resilient material and the outer ends of the legs extend away from each other, the openings in the end clip being separated a distance less than the distance between the outer ends.

3. The hair waving device of claim 1 in which the openings are elongated and each opening has projections extending inwardly, the projections being thinner than the area surrounding the openings so that the projections are bendable and tend to grip the legs of the curler when inserted through the openings.

4. The hair waving device of claim 1 in which the first and second walls are each hinged to a narrow center portion, and the openings are located in the center portion.

5. The hair waving device of claim 4 in which each of the first and second walls is provided with a pair of retaining members extending upwardly from the surfaces of the walls that face each other when the walls are moved toward each other, each pair of retaining members being spaced apart along the axis of the hinged connection a distance greater than the width of the curler across its legs, and each retaining member extends generally from the hinged connection outwardly so as to be along the legs of the curler when the end clip is combined with the curler.

6. The hair waving device of claim 5 in which the height of the retaining members of the first wall when combined with the height of the retaining members of the second wall is approximately the same as the thickness of the center portion between the walls.

7. The hair waving device of claim 1 in which the locking means includes a locking opening in the first wall located near each outer corner, and a corresponding locking lug extends outwardly from the second wall near each outer corner so as to engage the corresponding locking opening in the first wall.

8. The hair waving device of claims 1, 2, 3, 4, 5, 6 or 7 in which the end clip is of a relatively soft, flexible material and the first and second walls are relatively thin.

9. The hair waving device of claims 1, 2, 3, 4, 5, 6 or 7 in which the first and second walls are each provided with the plurality of openings extending through the wall so as to provide for air circulation through the openings to the inside of the end clip.

* * * * *